United States Patent [19]

Litchfield et al.

[11] 4,427,245

[45] Jan. 24, 1984

[54] DRAWER PANEL WITH TRACK INSERT

[75] Inventors: Leon G. Litchfield; Terence Hardy, both of Belper, England

[73] Assignee: L.B. (Plastics) Limited, Belper, England

[21] Appl. No.: 223,532

[22] Filed: Jan. 8, 1981

[30] Foreign Application Priority Data

Jan. 11, 1980 [GB] United Kingdom ..... 8000960

[51] Int. Cl.[3] ..... A47B 88/00

[52] U.S. Cl. ..... 312/330 R; 312/338; 312/341 R

[58] Field of Search ..... 312/330 R, 338, 345, 312/349, 341 R, 111; 308/3.8

[56] References Cited

U.S. PATENT DOCUMENTS

| | | | |
|---|---|---|---|
| 221,307 | 11/1879 | Hirsch | 312/338 |
| 781,530 | 1/1905 | Jespersen | 312/338 |
| 3,456,996 | 7/1969 | Heiniger-Schar | 312/330 R |
| 3,653,735 | 4/1972 | Duepree | 312/330 R |
| 3,664,716 | 5/1972 | Johnson | 308/3.8 |
| 4,042,288 | 8/1977 | Litchfield | 312/330 R |
| 4,232,921 | 11/1980 | Peele | 312/338 |
| 4,298,234 | 11/1981 | Litchfield et al. | 312/330 R |

FOREIGN PATENT DOCUMENTS

| | | | |
|---|---|---|---|
| 1135683 | 12/1968 | United Kingdom | 312/330 R |
| 1519554 | 8/1978 | United Kingdom | 312/330 R |

*Primary Examiner*—Victor N. Sakran

*Attorney, Agent, or Firm*—W. Thad Adams, III

[57] ABSTRACT

A drawer wall panel comprises a main panel member of extruded plastics material having an elongated recess extending longitudinally of the face of the panel member which will be outermost in use, and an elongated molded plastics insert defining a runner track located in the recess in the panel member and retained against lateral withdrawal by longitudinal lips formed at the edges of the recess in the panel member which project across the mouth of the recess into engagement with longitudinal grooves in the insert. The insert incorporates integrally formed projections extending inwardly thereof for engagement during use with components of a pre-determined type of drawer runner.

10 Claims, 6 Drawing Figures

24

21a
25
21b
14

5
27
14
26
6a
8
15
23
14
6b
17a
18
20
22a
7
21a
22b
19

14
6c
16
21b
17b

DRAWER PANEL WITH TRACK INSERT

This invention relates to drawers and components for use in constructing drawers.

Furniture manufacturers make extensive use of drawers constructed in component parts which are supplied by drawer manufacturers in "knocked-down" or disassembled condition and are then assembled by the furniture manufacturer and incorporated in his articles of furniture. In general such drawers are produced in a standard range of heights or depths but vary in width and length. Variation also occurs in the nature of the runners on which the drawers are mounted in use. Problems therefore arise in manufacturing such drawers to suit these different requirements without incurring unacceptable expense in producing separate tooling for each different variation of drawer required.

The side walls of many such drawers are commonly manufactured by extrusion from plastics material in continuous lengths which are then cut to the desired sizes to meet customer's requirements This avoids the need to produce separate tools for different widths and lengths of drawer but the extrusion process requires that the drawer wall panel be of constant cross-section throughout its length and this introduces limitations, particularly as regards incorporation of stop members and other components for co-operation with drawer runners on which the assembled drawer will be mounted in use.

It is an object of the present invention to provide a drawer construction in which some of these disadvantages may be obviated or mitigated.

The invention provides a drawer wall panel comprising a main panel member provided with an elongated recess extending longitudinally thereof on the face which will be outermost in use, and an elongated insert located within the recess in the panel member and retained against lateral withdrawal therefrom, said panel member being of hollow section formed by extrusion from synthetic plastics material and said insert being a pre-formed component of moulded plastics construction defining a runner track and incorporating integral formations projecting inwardly thereof for engagement during use with components of a drawer runner assembly.

The insert may be retained by retaining means comprising longitudinal lips formed at the edges of said recess in the panel member and projecting across the mouth of the recess into engagement with longitudinal grooves in the insert.

Further retaining means may advantageously be provided to retain the insert against longitudinal displacement relative to the recess in the panel member.

The panel member preferably incorporates a longitudinal slot in the face thereof opposite to that in which said recess is formed, said slot serving in use to receive on edge of a drawer bottom.

Preferably the panel member is adapted to be connected to other drawer wall panels to form an assembled drawer by means of connecting pieces having projecting spigots which engage in hollow ends of the panel member and are retained therein. For example, the spigots may be retained by means of detents projecting therefrom and engaging in holes formed adjacent the ends of the panel members.

Embodiments of the invention will now be described, by way of example only with reference to the accompanying drawings, in which.

Figures 1, 2, 3:
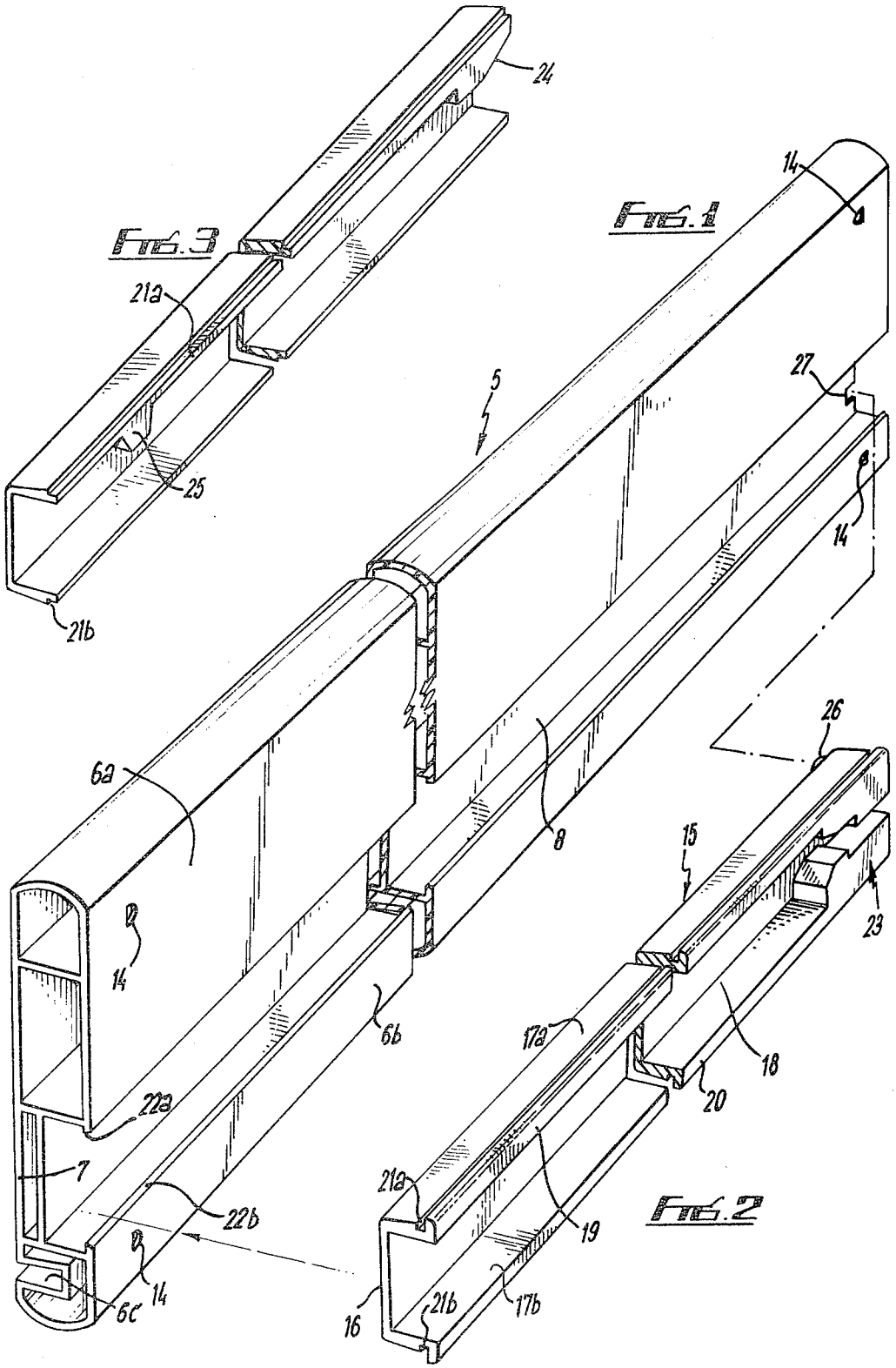
FIG. 1 is a perspective view of a main panel member of a drawer wall panel constructed according to the invention.
FIG. 2 is a perspective view of one form of runner track insert adapted for engagement with the panel member shown in FIG. 1.
FIG. 3 is a perspective view of an alternative form of runner track insert for engagement with the panel member of FIG. 1.
Figure 4:
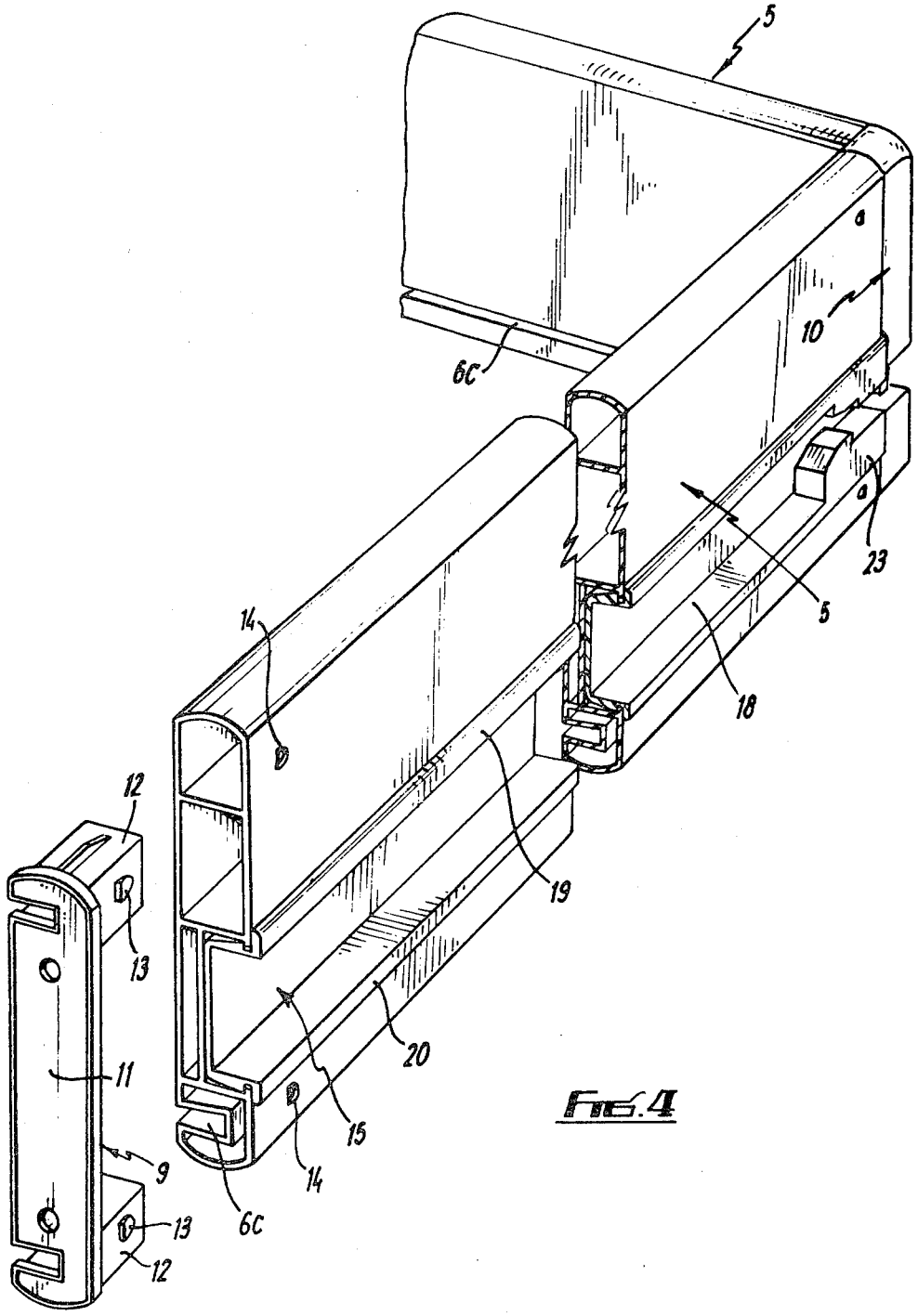
FIG. 4 is a perspective view of part of a drawer incorporating a wall panel according to FIG. 1 and a runner track insert according to FIG. 2.
Figure 5:
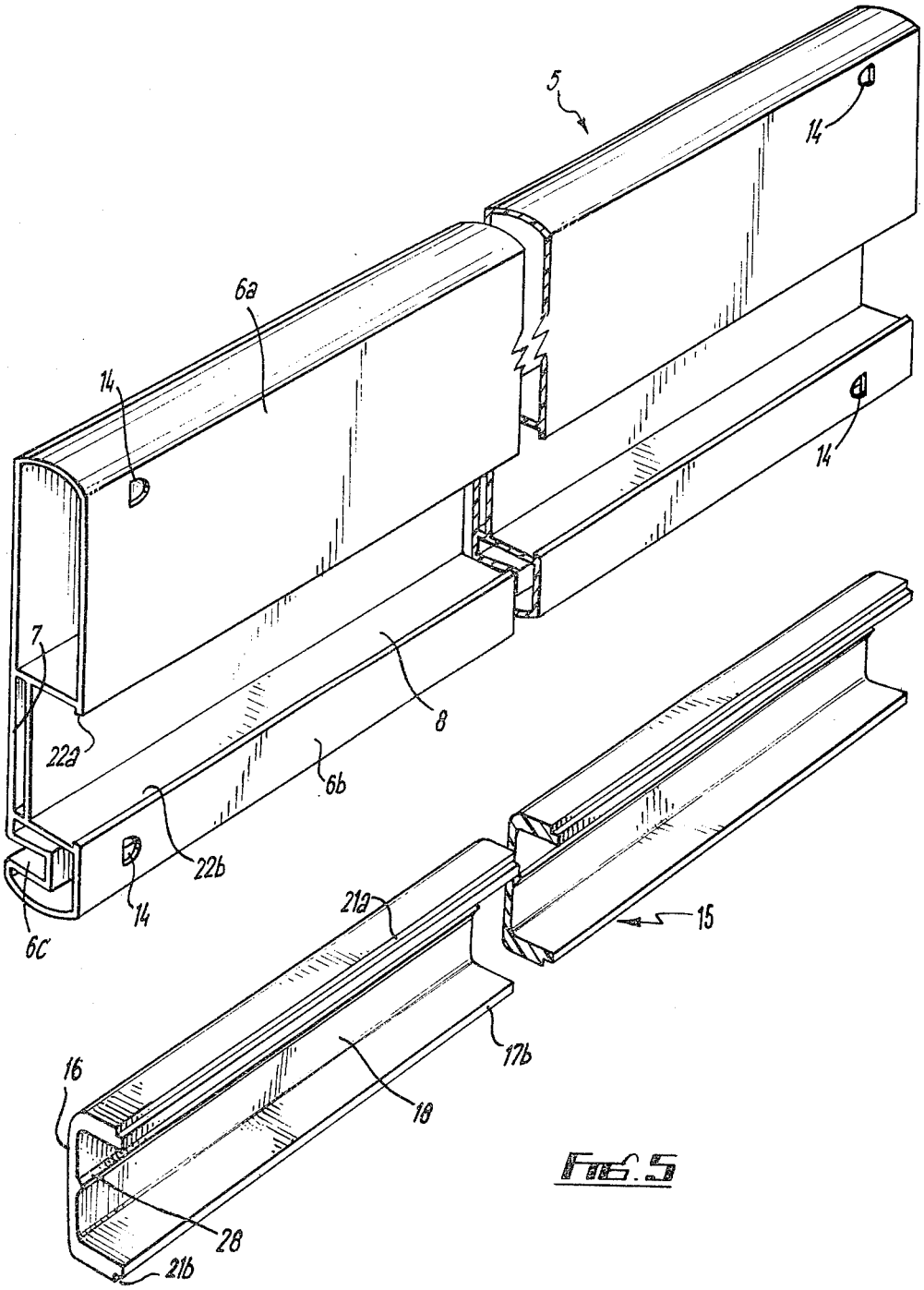
FIG. 5 is a perspective view showing an alternative form of insert in a position withdrawn from an associated panel.

Referring to the drawings, there is shown in FIGS. 1 and 5 a main body portion of a drawer wall panel comprising a panel member 5 in the form of a hollow section profile extruded from plastics material and having upper and lower sections 6*a* and 6*b* interconnected by a hollow web 7 which defines, together with the upper and lower sections, a recess 8 extending longitudinally of the panel member and formed on the face thereof which will be outermost when the panel member is assembled with other panel members to form a drawer as shown in FIG. 4. For this purpose front and rear connecting pieces 9 and 10 (FIG. 4) are provided. The front connecting piece comprises a face plate 11 adapted to be secured by screws or the like to a drawer front (not shown) and having rearwardly projecting spigots 12 each of which carries a projecting detent 13. The spigots are adapted to form a close push fit within the hollow end of the panel member 5 and the detents 13 engage in holes 14 formed adjacent the ends of panel member. The rear connecting piece 10 is provided with similar spigots and detents but is in the nature of a corner piece having spigots projecting in two directions at right angles so as to be engageable in the ends of two adjacent panel members to connect them at right angles to one another as shown in FIG. 4. A longitudinal slot 6*c* is provided in the face of the panel member which is innermost in use to receive the edge of a drawer bottom.

The recess 8 is adapted to receive and retain a separate insert 15 defining a runner track, the insert being of plastics construction examples of which are shown in FIGS. 2, 3 and 5. Each insert is of generally U-shaped cross-section so as to be received within the recess 8 in the panel member 5 and comprises a back wall 16 and upper and lower walls 17*a*, 17*b* which define a track 18 adapted in use to receive a runner assembly on which the drawer is mounted. In the embodiment shown in FIG. 2, the outer edges of the upper and lower walls 17*a*, 17*b* have upwardly and downwardly directed flanges 19 and 20 respectively behind which longitudinal grooves 21*a* and 21*b* respectively are formed. These grooves are adapted to engage with longitudinal lips 22*a*, 22*b* respectively, which project from the upper and lower edges of the recess 8. Because of the inherent resilience of the plastics material from which the insert is moulded, the insert may be pressed into the recess 8 until the grooves 21*a*, 21*b* are aligned with the lips 22*a*, 22*b*, whereupon the walls 17*a* and 17*b* of the track spring outwardly and retain the insert against lateral withdrawal from the recess 8. The lips 22*a*, 22*b* are slightly chamfered to facilitate entry of the insert.

In the form of insert shown in FIG. 2, a guide and stop formation 23 projects into the track 18 at its rear end. This serves to support and guide the assembled drawer on a particular form of runner incorporating stop means to prevent withdrawal of the drawer from its supporting housing during normal use and enabling tilting movement to permit withdrawal when this is desired. The arrangements shown in FIGS. 3 and 5 differ from that of FIG. 2 in that the lips 19 and 20 are omitted although the grooves 21*a* and 21*b* are retained and co-operate with the lips 22*a* and 22*b* of the panel member in the same manner as in the FIG. 2 embodiment. The FIG. 3 arrangement incorporates a modified form of rear stop 24 and a front stop member 25. The precise function of these elements is not relevant to the invention save in so far as they illustrate that it is possible to incorporate these and other similar forms of projection in a moulded runner track insert while still retaining the facility for producing the main body portion of the wall panel itself by a continuous extrusion technique. The insert shown in FIG. 5 is of uniform cross-section throughout its length. It incorporates a longitudinal rib 28 projecting into the channel 18 from the rear wall 16 which prevents face-to-face contact between the drawer runner and the wall 16 and hence substantially reduces friction and improves the sliding action of the drawer.

Figure 6:
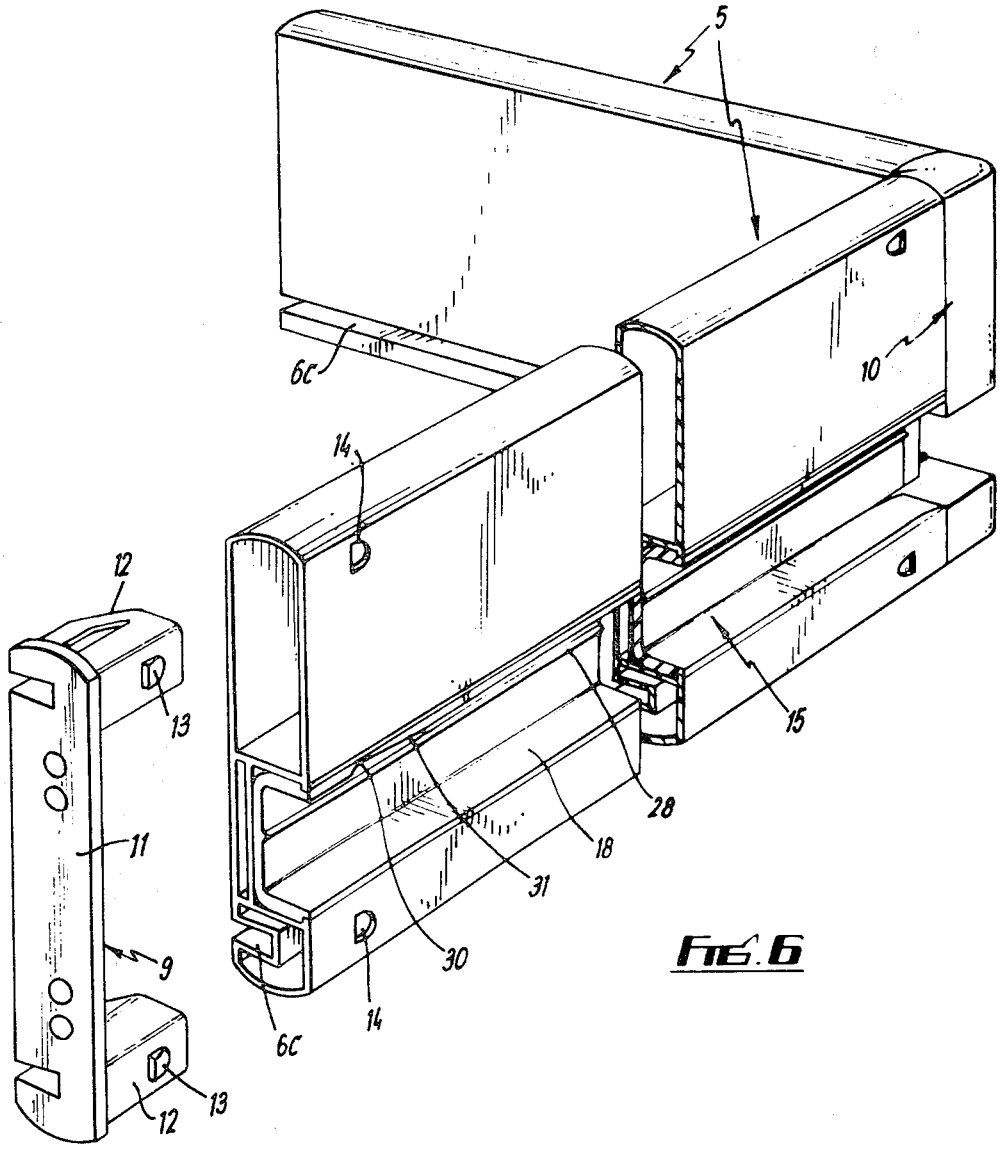
FIG. 6 is a perspective view similar to FIG. 4 showing the panel and insert of FIG. 1 in their assembled condition.

As will be seen from FIGS. 4 and 6 of the drawings, when the wall panel is assembled with other components to form a drawer, the front connector 9 and rear corner connector 10 project at least partially across the ends of the recess 8 and thereby prevent longitudinal movement of the runner track insert in the recess 8. However in many instances the components will be despatched from the factory in a partly assembled condition with only the rear connector 10 fitted to the side wall panel member. In this condition it would be possible for the insert to slide longitudinally of the recess 8 and thereby become detached from the panel member. In order to prevent this, a projection 26 (FIG. 2) may be provided on the rear wall 16 of the runner track for engagement with a notch 27 (FIG. 1) formed in the rear wall of the recess 8. The notch 27 may be formed by a separate cutting operation after the panel member has been extruded and cut to the desired length. The holes 14 are also produced at this stage by a separate operation or simultaneously with the notch 27. In will be appreciated that a similar projection and notch could be provided at the forward end of the insert and of the panel member to prevent relative sliding movement in either direction or this could be achieved by a projection similar to the projection 26 displaced from one end of the insert and engaged in a hole formed a corresponding distance from the end of the panel member.

As shown in FIG. 6 a recess 30 incorporating a ramp 31 may be formed in the upper wall 17*a* of the insert. The recess and ramp serve in co-operation with a roller or other component of the runner assembly to effect self-closing of the drawer over the last part of its closing movement.

By virtue of the arrangements described the main body portion of the drawer wall panel may be cut from a continuous extruded length thereby avoiding the need to provide special tools for manufacturing different lengths or widths of drawer, but the panel may be adapted to different mounting arrangements by incorporation of a suitable runner track in the form of a separately manufactured insert which can be produced by a moulding technique and thereby incorporate integral stops or other formations which could not be produced by extrusion. Different lengths of runner track would, of course, require to be produced for different lengths of drawer, but this reduces the separate tooling to that required to produce the inserts only and enables the main panel body to be manufactured in continuous lengths. The arrangements described also have the advantage that the strength of the wall panel is increased compared with a panel formed entirely by extrusion since the separate insert serves to increase the wall thickness at that area and rigidify the panel as a whole. The load carrying capacity is also increased due to the increased wall thickness and rigidity and in addition it is possible to provide a smoother running drawer since moulding techniques enable the production of a more accurate running face than can be produced by extrusion. A further advantage arises from the fact that the same inserts can be fitted to panel bodies of different depth or height provided they have recesses of similar dimensions, thereby further reducing tooling costs.

Various modifications may be made without departing from the invention. For example the nature of the projections or other formations formed in the runner tracks may be varied as desired and different means may be provided for retaining the inserts in the panel members. For example the inserts could be retained in position by adhesive or other suitable means.

We claim:

1. Drawer wall components for the production of drawers of different length or width or for mounting on different drawer runner assemblies, comprising a wall-forming panel member or uniform cross-section appropriate lengths of which are selected to form the drawer sides and back in accordance with the length and width or the drawer to be formed, and which incorporates a longitudinal recess in the face thereof which will be outermost when the drawer is assembled, and a plurality of alternatively useable inserts of elongated form adapted for engagement in said recesses in the lengths of panel member forming the drawer sides, each of said inserts incorporating integrally formed projections for cooperation with a pre-determined type runner on which the drawer is adapted to be mounted.

2. A drawer wall panel according to claim 1 wherein the panel member is adapted to be connected to other drawer wall panels to form an assembled drawer by means of connecting pieces having projecting plugs which engage in hollow ends of the panel member and are retained therein.

3. A drawer wall panel according to claim 2 wherein said spigots are retained by means of detents projecting therefrom and engaging in holes formed adjacent the ends of the panel members.

4. A drawer wall panel according to claim 1 wherein said insert is retained by retaining means comprising longitudinal lips formed at the edges of said recess in the panel member and projecting across the mouth of the recess into engagement with longitudinal grooves in the insert.

5. A drawer wall panel according to claim 4 wherein further retaining means is provided to retain the insert against longitudinal displacement relative to the recess in the panel member.

6. A drawer wall panel according to claim 5 wherein said further retaining means comprises a projection on said insert engageable in a complementary aperture in said recess in the panel member.

7. A drawer wall panel according to claim 4 wherein said panel member incorporates a longitudinal slot in the face thereof opposite to that in which said recess is formed, said slot serving in use to receive an edge of a drawer bottom.

8. A drawer wall panel according to claim 1,2 or 4 wherein said insert is provided with a longitudinally extending rib projecting into said runner track from the rear wall of the insert.

9. A drawer wall panel according to claim 1,2 or 4 including a formation disposed towards the end of said insert which is adjacent the front of the drawer in use for co-operation with an associated runner to apply a self-closing movement to the drawer.

10. A drawer wall panel comprising a main panel member provided with an elongated recess extending longitudinally thereof on the face which will be outermost in use, and an elongated molded plastic insert located within the recess in the panel member and retained against lateral withdrawal therefrom, said panel member comprising an extruded hollow synthetic plastics material and said insert defining a runner track and and incorporating integrally formed projections extending inwardly thereof for cooperation with a pre-determined type runner on which the drawer is adapted to be mounted, said insert being retained by retaining means comprising longitudinal lips formed at the edges of said recess in the panel member and projecting across the mouth of the recess into engagements with longitudinal grooves in the insert.

* * * * *